US005975781A

United States Patent [19]

Ackermann et al.

[11] Patent Number: 5,975,781

[45] Date of Patent: Nov. 2, 1999

[54] LIPSTICK AND METHOD FOR MAKING SAME

[76] Inventors: Walter T. Ackermann, 159 Fern Hill Rd., Watertown, Conn. 06795; Joseph A. Pietrorazio, 585 Middle Rd. Turnpike, Woodbury, Conn. 06798

[21] Appl. No.: 09/149,246

[22] Filed: Sep. 8, 1998

[51] Int. Cl.[6] ..... A45D 40/04

[52] U.S. Cl. ..... 401/69; 401/68; 401/55

[58] Field of Search ..... 401/69, 55, 75, 401/170, 68, 76, 72, 173, 179

[56] References Cited

U.S. PATENT DOCUMENTS 2,395,710 2/1946 Anderson .
2,419,526 4/1947 Anderson .
2,506,984 5/1950 Anderson .
3,348,740 10/1967 O'Donnell .
4,615,632 10/1986 Iwamoto et al. ..... 401/69
4,616,947 10/1986 Iwamoto et al. ..... 401/69
4,770,556 9/1988 Ackermann et al. .
5,172,993 12/1992 Ackermann et al. .
5,234,275 8/1993 Gueret .
5,653,338 8/1997 Tani .

*Primary Examiner*—David J. Walczak
*Attorney, Agent, or Firm*—Dallett Hoopes

[57] ABSTRACT

The mechanism of this lipstick has telescoping non-circular sections between base and pomade cup to assure their rotation together. Outward flanges help stabilize the sections laterally. The telescoping sections are assembled by axially collapsing a pre-form.

23 Claims, 4 Drawing Sheets

FIG.3
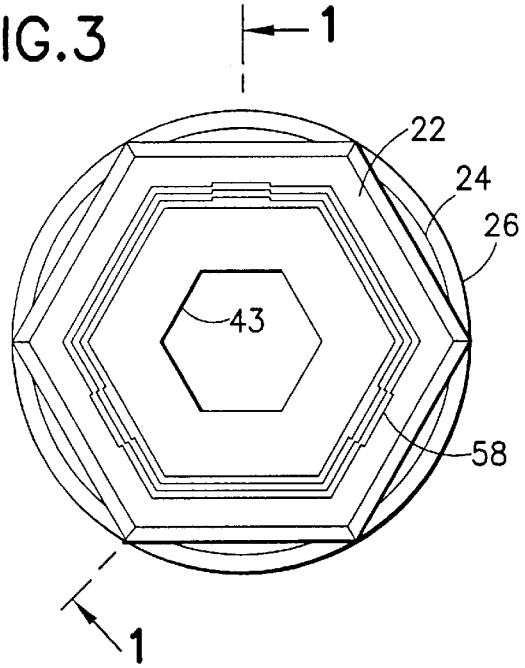
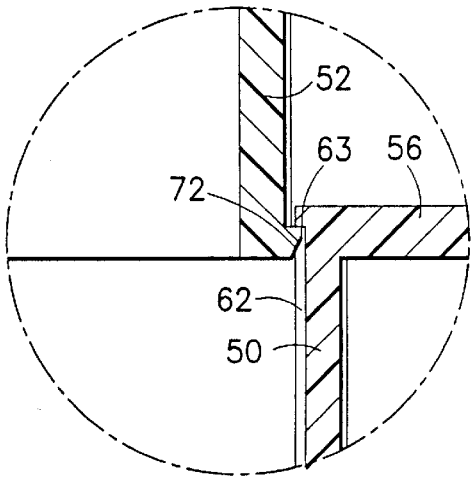
FIG.4
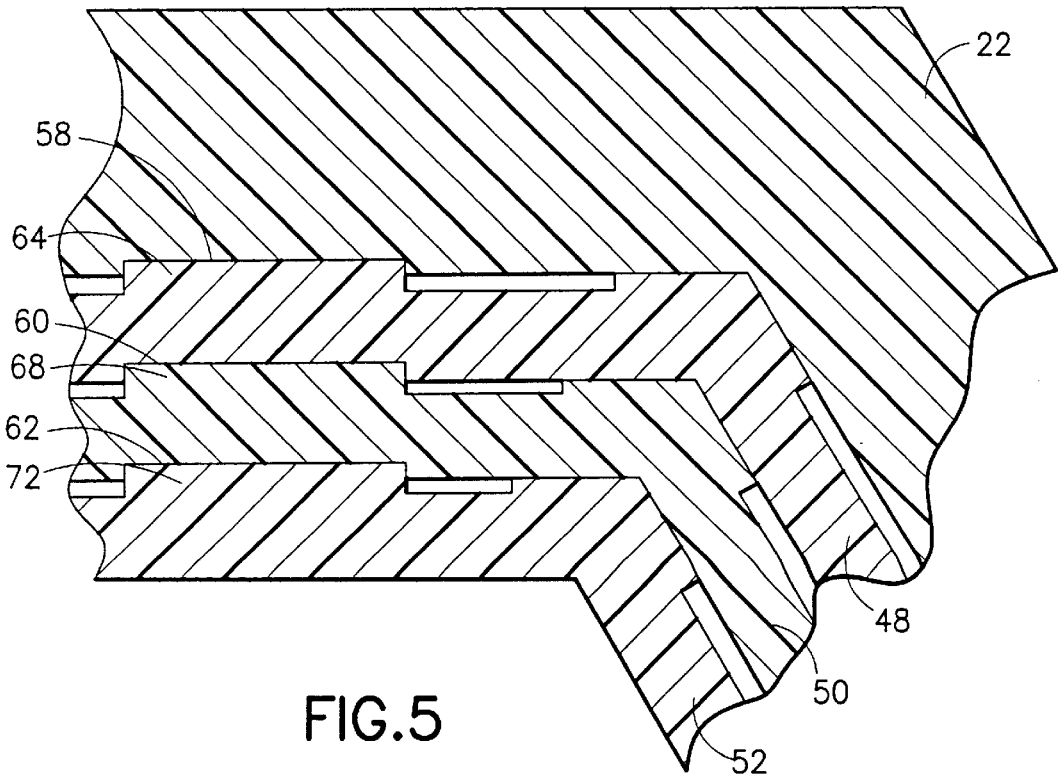
FIG.5

LIPSTICK AND METHOD FOR MAKING SAME

FIELD OF THE INVENTION

This invention relates to a lipstick container, hereinafter called a "lipstick", of the propel/repel variety. More specifically, the invention relates to a lipstick mechanism. It also relates to an efficient method of making the mechanism.

BACKGROUND OF THE INVENTION

Lipsticks, along with their operating mechanisms, have evolved from simple containers for enclosing and exposing the product (pomade) into complex and sophisticated systems. The industry regards as paramount the following criteria:

1. Cost. Above all else, in the highly competitive cosmetic industry, the container manufacturer is under immense pressure to provide a product at the lowest possible cost.

2. Dimension. Offer the smallest possible outside diameter without compromising the size of the pomade in order to achieve a slim appearance.

3. Sealability. Be capable of being sealed to contain the highly volatile pomade formulations that are currently in vogue.

4. Operation. When turned by the user to propel the product, must feel elegantly smooth.

5. Cup control. Hold the pomade in an erect manner with a minimum of side play so that it does not contact the surrounding surfaces of the mechanism.

6. Assembly. Allow simple assembly of the components that can be accomplished in conjunction with the parts molding operation.

7. Disassembly. Allow easy disassembly ancL categorization of the parts to comply with ever-increasing recycling legislation.

Currently available commercial mechanisms have attempted to satisfy sealability, operation and cup control criteria. There are none that address the cost, dimension, assembly and disassembly criteria. One noted attempt to improve the dimension issue is disclosed in the old U.S. Pat. Nos. 2,395,710 and 2,419,526 of J. W. Anderson of Newtown, Conn. in 1946 and 1947 respectively. While meritorious, these patents did not address the other issues, especially the cost. Many patented designs have not been commercially pursued for failure to measure up to one or more of these criteria.

SUMMARY OF THE INVENTION

The present invention may be expressed as a lipstick mechanism comprising a cam sleeve having a spiral track and a pomade-carrying assembly including a cup reciprocally disposed inside the cam sleeve and having outward lugs riding in the track, a mechanism base rotatably connected to the end of the cam sleeve, and a column of variable length connecting the base and cup for rotation together. In the preferred version the column comprises a plurality of linked telescoping sections of non-circular cross-section, the sections having outward flanges to steady the respective sections against lateral collapse.

Other features are sealing means between base and cam sleeve and between cap and cam sleeve; pointed lugs on the cup riding in V-shaped tracks in the cam sleeve and the tracks formed with shallow spots to provide ride-by structures. These features are all made possible and optimized by the primary aspect of the invention as described in the next above paragraph.

The invention may also be expressed as a method in which the telescoping sections are at first molded as a pre-form with the cup and mechanism base as a single part held in axial relation by spaced frangible radial connectors. The manufacture includes the dramatic step in which the pre-form is axially collapsed into telescoping sections held together by hook and groove arrangements. The hooks yield as they ride downwardly over the upper ends of the next adjacent units respectively, leaving the hooks slidable respectively in grooves on the inside walls of the telescoping sections.

BRIEF DESCRIPTION OF THE DRAWINGS

Further objects and features of the invention will be clear to those skilled in the art from a review of the following specification and attached drawings, all of which present a non-limiting form of the invention. In the drawings:

FIG. 3 is an enlarged bottom plan view of the drive mechanism with the cap and the base cup removed;

FIG. 4 is an enlarged sectional view of the indicated portion of FIG. 2;

FIG. 5 is a greatly enlarged fragmentary sectional view taken on the line 5—5 of FIG. 1;

DESCRIPTION OF THE PREFERRED EMBODIMENT

Figure 1:
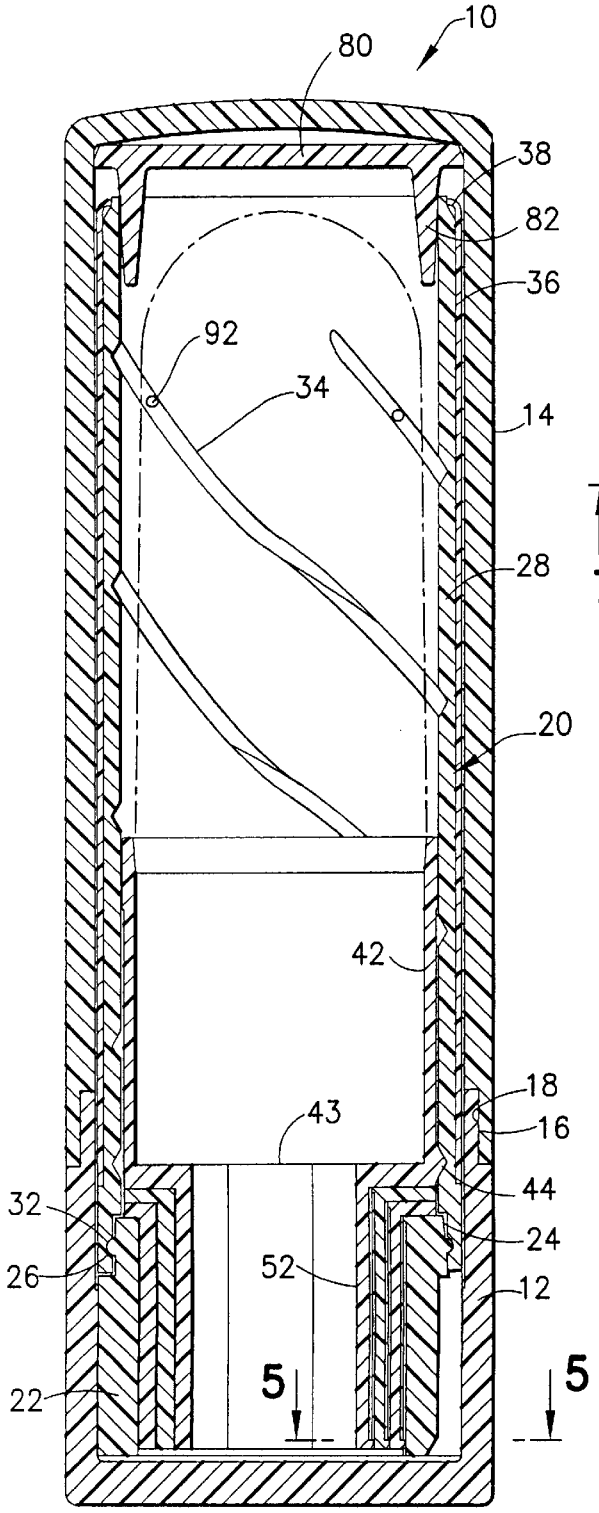
FIG. 1 is a centerline section of a lipstick embodying the invention with pomade shown in phantom and pomade cup retracted.

A lipstick embodying the invention is shown in simplified form in FIG. 1 and generally designated 10. The "fashion parts" comprise a cup-shaped fashion base 12 and an inverted cup-shaped cap 14. The mouth of the base 12 is formed with an inward step 16 and the inside of the mouth of the cap is formed with an outward step 18 as shown and the steps telescope together in a snug fit in closing.

Inside the fashion parts the mechanism is generally designated 20. It comprises a mechanism base 22 inserted in the fashion base 12 and sealed thereto, and thus the base 12 and base 22 rotate together. The mechanism base 22 is formed with an inwardly stepped mouth 24 having an outwardly facing circular sealing rib 26. As shown in FIG. 3, the base 22 below the circular mouth 24 and rib 26 is hexagonal in shape and has a central hexagonal opening 43.

Figure 6:
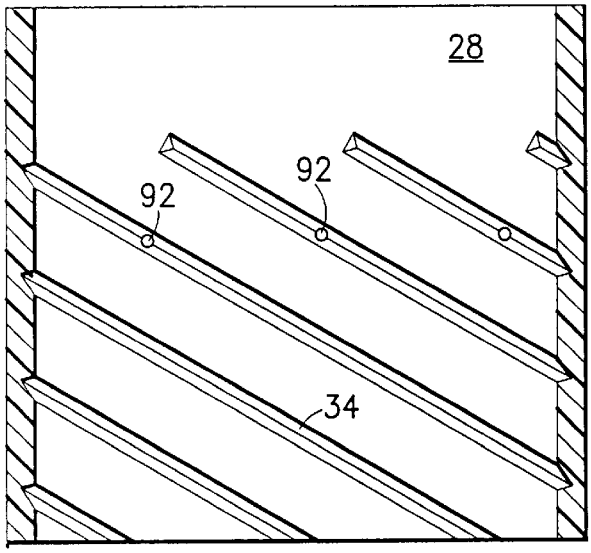
FIG. 6 is a developmental view of the inside of a portion of the cam split longitudinally and laid out flat to show the nature of the spiral tracks.
Figure 7:
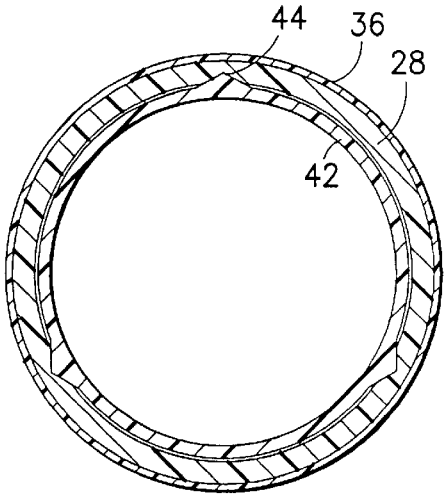
FIG. 7 is an enlarged sectional view taken on the line 7—7 of FIG. 2.
Figure 8:
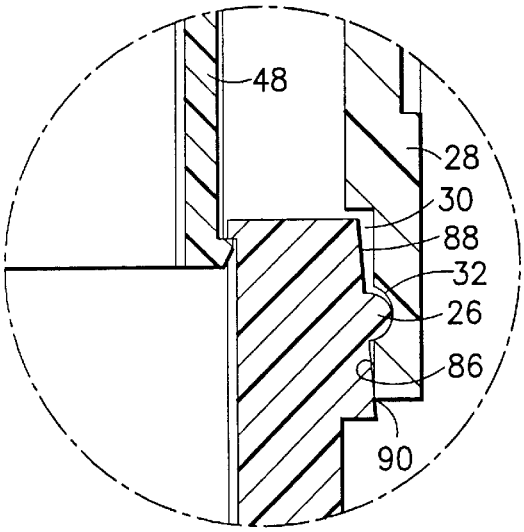
FIG. 8 is an enlarged sectional view of the indicated portion of FIG. 2.

A cam sleeve 28 is formed about the inside of its lower end with a reduced area 30 (FIG. 8) and a recess 32 which snaps over the rib 26 and is rotatable thereon. The inside of the sleeve 28 is formed with a plurality of spiral tracks 34 (FIG. 1), each of which is V-shaped (FIG. 6), the side walls of the tracks converging to a point. Press fitted to the exterior of the cam sleeve 28 is the metal shell 36 which has a pierced hole at its upper end 38 which hugs the inwardly stepped mouth of the cam sleeve (FIG. 1).

A pomade cup 42 having a central opening 43 is rotatably but snugly disposed in the cam sleeve. At its lower end the cup is formed with outward pointed lugs 44 which engage in the tracks 34.

Connecting the base 22 and the cup 42 and assuring their rotation together, is a column 46 of variable length. In the preferred form the column comprises a plurality cf telescoping sections which includes the base 22 itself, a lower telescoping section 48, an intermediate telescoping unit 50 and an upper telescoping section 52. The upper telescoping section 52 is a stem on the cup unitarily formed with the pomade cup 42. Each of the telescoping sections has a generally non-circular exterior and non-circular interior of similar configuration. Specifically, in the preferred version, the openings and exteriors are hexagonal and sized so that each section fits snugly but slidably into the section below.

The lower telescoping section 48 and the intermediate telescoping section 50 each have at their upper ends circular stabilizing flanges 54 and 56, respectively. These flanges extend outward almost to the inside diameter of the cam sleeve 28 and may at times engage the cam sleeve 28 to assure there is no lateral movement of the respective sections.

Figure 13:
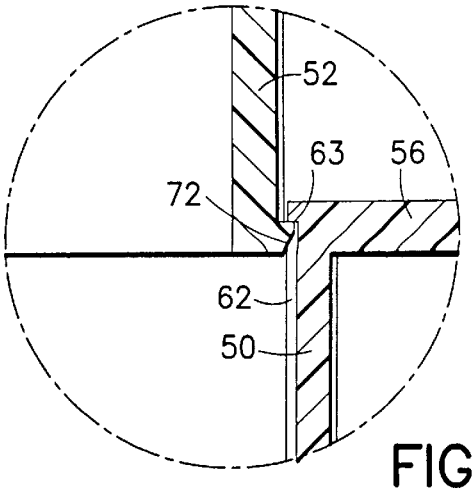
FIG. 13 is a view similar to FIG. 4 reproduced for comparison side-by-side with FIG. 10 of the pre-form and showing the relationship of the sections after collapse.

FIGS. 3, 4 and 5 disclose that on the inside of its wall on three alternate sides, the mechanism base 22 is formed with a shallow longitudinal groove 58. A similar shallow groove 60 is formed on the corresponding surfaces of the lower telescoping section 48 and similar groove 62 is formed on the intermediate telescoping section 50. As shown in FIG. 13, the shallow grooves 62 on the intermediate telescoping section 50 terminates short of its upper end in a blind end 63. This is true of the grooves 60 on the lower telescoping section 48 and the grooves 58 in the mechanism base 22 as well. The grooves thus each have a blind upper end; that is, the grooves terminate upwardly short of the upper ends of the respective sections.

Riding in the grooves during the raising and lowering of cup 42 are integral hooks (FIG. 4) on the lower end of the next-above section. For instance, the lower telescoping section 48 has a hook 64 (FIG. 5) which rides in the groove 58 in the base 22 until it abuts the upper end (not shown) of the groove 58 on the base. The intermediate telescoping section is formed with an integral hook 68 which rides in the groove 60 until stopped by the upper end (not shown) of the groove on the lower telescoping section and the hook 72 (FIG. 4) on the upper telescoping section 52 rides in the shallow groove 62 in the intermediate telescoping section 50 until stopped by the upper end 63. Thus, as the pomade cup 42 rises while the base 22 is turned relative to the cam sleeve 28, the telescoping sections stay connected, and each one pulls up the next lower section as the hooks reach the respective upper ends of the shallow grooves on the next lower section. On retraction, the bottom wall of the cup 42 and the flanges 56, 54 serve to push down the next lower section before the hooks move downward beyond the next lower section.

By virtue of the structure described, rotating the fashion base 12 relative to the shell 36/cam sleeve 28, causes the lugs 44 riding in the respective tracks to move the cup upwardly. The column 46, assuring rotation together of the cup 42 and the mechanism base 22, is able to accommodate the increasing distance between cup and base. Clearly, this can be achieved by other configurations of the telescoping parts. They can be of any non-circular cross-section, such as triangular, octagonal, or even circular having molded keys and keyways. However, the hexagonal embodiment shown is preferred.

There is thus eliminated from the structure of the lipstick the usual innerbody which comprises an additional thickness requiring an overall wider diameter of the lipstick.

Figure 9:
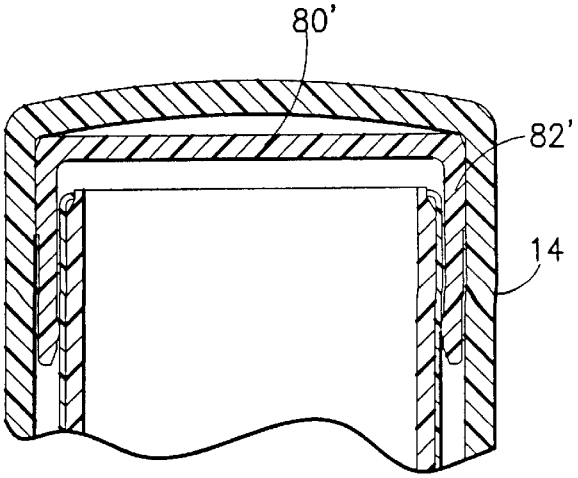
FIG. 9 is a fragmentary sectional view showing a modified form of sealing insert in the cap.

Because of the absence of the innerbody, the lipstick is much easier to seal. As shown in FIG. 1, the seal of the upper end of the lipstick may be achieved by a more or less conventional "stovepipe" 80 having a downward circular tapered wall 82. As is conventional, the stovepipe may be secured to the top wall of the cap by cement or the like. The resilient nature of the tapered wall 82 permits it to wedge in sealing fashion against and about the inside of the mouth of the cam sleeve, sealing the interior of the sleeve at the upper end. A second form of upper seal (FIG. 9) may be of the inverted cup-shape sleeve seal 80' which, again, is cemented in the cap against the top wall thereof. The inside surface of the sleeve seal peripheral wall 82' can engage the outside of the seal in sealing fashion.

At the lower end of the cam sleeve the rotatable sleeve is sealingly connected to the base which is, of course, fixedly secured inside the fashion base 12. The sealing connection is made by the rib 26 which rides in the recess 32 inside the lower end of the cam sleeve 28. As shown, the base structure on either side 86, 88 of the rib 26 is tapered in an upward direction (FIG. 8) so that the very distal edge of the cam sleeve 28 sealingly contacts the side 86 of the base in a sealing line contact 90 still enabling rotation of the cam sleeve on the base. This contact serves not only as a seal but also provides a steady friction to give the lipstick a "silky" feel as the parts are rotated. It also offers enhanced push-back resistance, preventing the pomade from retracting when the user applies pressure to it during use.

A further advantage of the absence of the usual innerbody is that the cup is snug inside the cam sleeve with no intervening wobbly innerbody, the lugs 44 on the pomade cup can be pointed and directly engage into the V-shaped grooves 34 of the respective tracks. This enhances push-back resistance. Because the outside of the cup can be made virtually the same diameter as the cam sleeve, there is little wobble of the cup within the container, reducing the liklihood of side damage to the pomade stick. The stability is heightened by having the cup stem 52 received into the telescoping section 50 giving greater laterally supported length-to-diameter ratio of the cup.

The pointed lugs on the cup and the V-shaped groove in the cam tracks additionally give more precise control of the movement with less wobble and play. Further, as shown in FIG. the tracks 34 may be provided with shallow spots or barriers 92 which are ride-by stops for filling.

Figure 2:
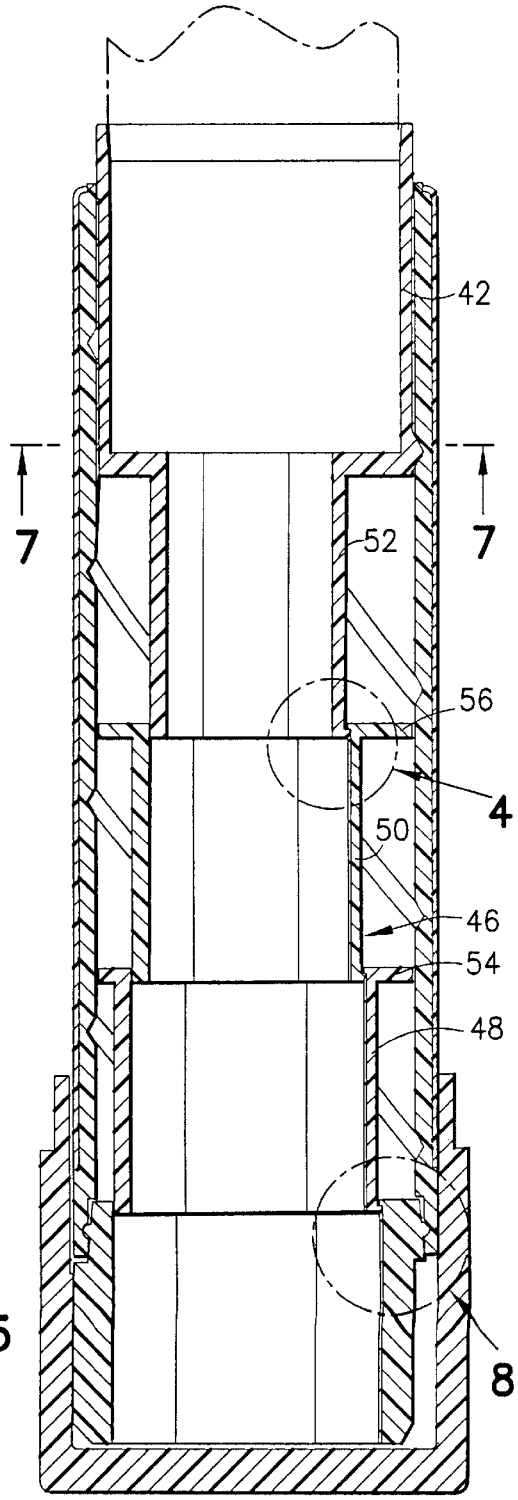
FIG. 2 is a view similar to FIG. 1 with cap removed and with the pomade cup fully extended.

In the filling position shown in FIG. 2, the lugs 44 of the cup have been driven past the shallow spots 92 of the tracks 34. This is the only occasion probably during the life of the lipstick that the pomade cup will be brought up to this level. In normal use the user will sense the obstruction of the ride-by 92 and will sense that she has reached the top of the travel. This normal top position is where the top of the cup 42 is flush with the top of the cam 28.

Figure 10:
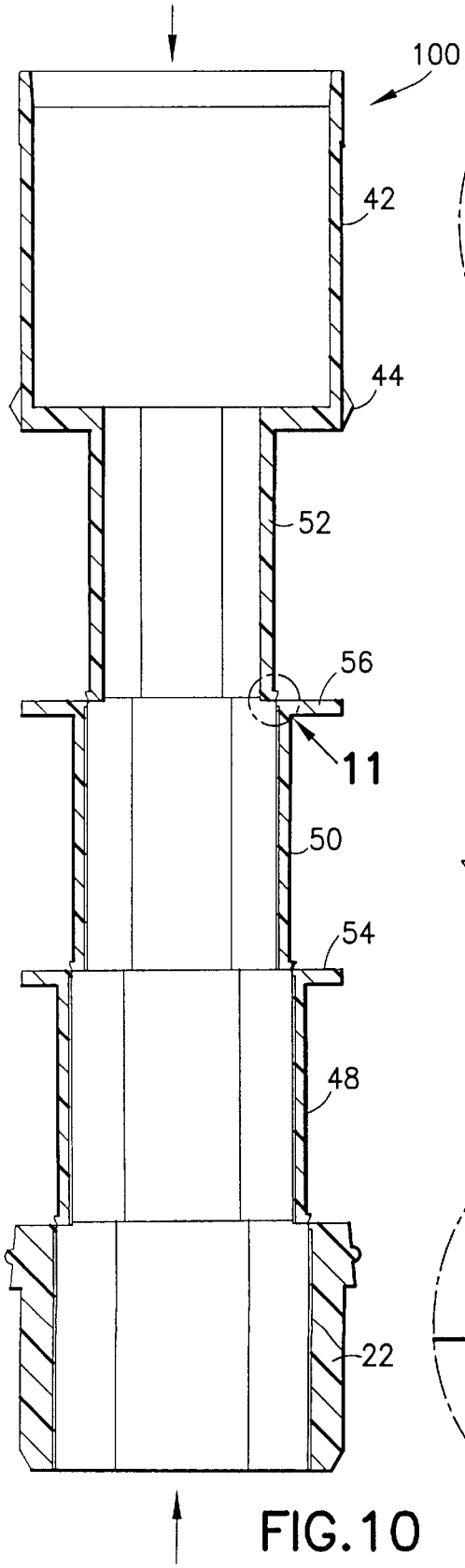
FIG. 10 is a sectional view of the pre-form for the pomade cup, base, and telescoping drive sections before axial collapse. Dotted lines indicate schematically the wall of a cavity in which parts are collapsed.
Figure 11:
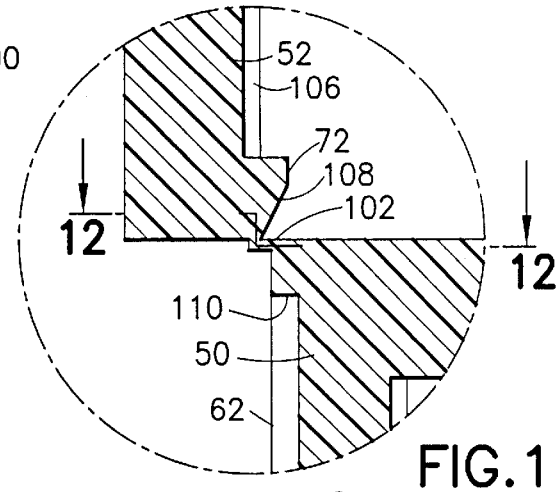
FIG. 11 is a greatly enlarged view of the indicated portion of FIG. 10.
Figure 12:
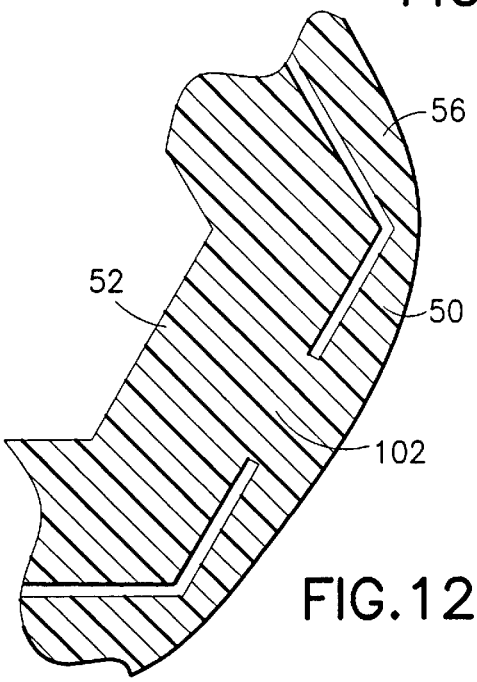
FIG. 12 is a reduced fragmentary sectional view taken on the line 12—12 of FIG. 11 showing one of the frangible connectors.

FIGS. 10, 11 and 12 relate to the pre-form 100 for the mechanism including the telescoping sections. FIG. 10 is a vertical section through a pre-form adapted to produce part of the mechanism of the above-described lipstick. The pre-form is in the form of the base 22 and the pomade cup 42 which are joined together and unitarily molded with the intervening column 46 of collapsible telescopable sections. Even though the pre-form is a single molded item, reference numerals which are the same as in the finished product as shown in FIG. 2, have been used for simplicity in identification.

The closeup view of FIG. 11 shows, for instance, that the upper telescoping section which extends down from the cup 42, is formed with the hook 72 above the top of the intermediate telescoping section 50 and connected thereto by a plurality of frangible bridges or connectors 102. FIG. 12, which is a dogleg section through the line 12—12, shows the continuum of plastic including the frangible connector 102. Just above the connector there is the hook 72 which, as shown, extends outward farther than the inner diameter of intermediate telescoping section 50 and is adapted to ride in the groove 62 of the intermediate telescoping section in the final assembly.

The frangible connector 102, as shown in FIGS. 11 and 12, is one of a plurality spaced around the periphery of the lower end of the upper telescoping section 52. Preferably, there are three such frangible connectors spaced 120° apart and, thus, on alternate walls of the unitary intermediate hexagonal telescoping section 50. The structure shown in FIGS. 11 and 12 is is replicated also at the contiguous zones of the intermediate and lower telescoping sections 50, 48 and the lower telescoping section and base 48, 22.

To reduce friction and accommodate molding distortion in the final product, it should be noted that the outer surface of the walls of the telescoping sections may be formed with a relief 106 (FIG. 11).

To form the mechanism into the collapsed telescoping assembly shown in FIG. 1, and including the mechanism base 22, the pomade cup 42 and the telescoping sections inbetween, it is merely necessary to confine the pre-form of FIG. 10 laterally as in a cylindrical space (dotted lines) and apply opposed axial forces as designated by the arrows in FIG. 10. This causes (FIG. 11) the frangible connectors 102 between each two telescoping sections to break. Immediately after, the hook 72, which has a tapered lead-in 108, engages the upper surface of the next lower section 50 and rides by the upper end of the next lower section. Having passed the upper end of the next lower section, the hook 72 snaps onto the groove 62 and thereafter connects the two sections 50, 52 in telescoping fashion with the blind upper end 110 of the groove 62 thereafter keeping the sections from separating as described. The final. relationship is as shown in FIG. 13. This relationship is replicated between each two adjacent telescoping sections after the axial collapse of the pre-form. The flanges 56 and 54 give lateral support to the column 46 during collapse. It is thereafter merely necessary to attach the cam sleeve to the upper end of the mechanism base 22.

With the shell installed on the cam sleeve and the pomade cup extended to the position shown in FIG. 2, the premolded pomade can be installed into the cup 42 or the mechanism can be inverted over an appropriate mold and pomade liquid can be poured through the openings in the hexagonal telescoping sections 48, 50, 52 and opening 43 into the cup 42 and mold. The fashion base 12 and the fashion cap 14, can be installed as described.

There is thus presented a novel lipstick having novel method of production. The invention satisfies all of the criteria referred to in the background section of this disclosure.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A lipstick comprising:

a. a cam sleeve having a spiral track and, b. a pomade-carrying assembly comprising a cup reciprocably disposed inside the cam sleeve and having an outward lug riding in the track, a base rotatably connected to the lower end of the cam sleeve, and a column of variable length connecting the base and cup for rotation together, the column comprising a plurality of interfitting tubular telescoping sections having similar non-circular cross-sectional shape, the telescoping sections on contiguous telescoping surfaces formed with interfitting hooks and longitudinal grooves respectively, one of the grooves having a blind end terminating short of an end of the telescoping section so that, when the cup is fully extended, the hook engages the blind end to limit the relative travel between said contiguous surfaces.

2. A lipstick container as claimed in claim 1 wherein the non-circular shape is hexagonal.

3. A lipstick as claimed in claim 1 wherein the spiral track is V-shaped in cross-section and the lug is pointed at its distal end.

4. A lipstick as claimed in claim 1 wherein the track is formed adjacent its end more remote from the base with a shallow zone to comprise a ride-by barrier for the movement of the lug and the cup.

5. A lipstick as claimed in claim 1 wherein at least one of the telescoping sections has an outward peripheral stabilizing flange extending to the inner surface of the cam sleeve.

6. A lipstick as claimed in claim 1 wherein the base is tapered toward the cup and is connected to the cam sleeve by being formed with a peripheral bead in the tapered area, and the sleeve is formed with an annular recess, the bead and recess being rotatably interengaged and the adjacent end of the cam sleeve engaging the taper to comprise a seal for the connection.

7. A lipstick as claimed in claim 1 wherein the container includes an inverted cup-shaped cap having a seal insert secured to the inside of the top wall of the cap, the upper end of the cam sleeve engages the insert to comprise a seal.

8. A lipstick as claimed in claim 7 wherein the insert includes a downward annular wall frictionally engaging the inside of the cam sleeve.

9. A lipstick comprising:

a. a cam sleeve having a spiral track and, b. a pomade-carrying assembly comprising a cup reciprocably disposed inside the cam sleeve and having an outward lug riding in the track, a base rotatably connected to the lower end of the cam sleeve, and a column of variable length connecting the base and cup for rotation together, the column comprising a plurality of interfitting tubular telescoping sections having contiguous surfaces of similar non-circular cross-sectional shape, at least one of the telescoping sections intermediate the base and cup having an outward flange adapted to engage the cam sleeve and stabilize the one section against lateral movement.

10. A lipstick container as claimed in claim 9 wherein the non-circular shape is hexagonal.

11. A lipstick as claimed in claim 9 wherein the spiral track is V-shaped in cross-section and the lug being pointed at its distal end.

12. A lipstick as claimed in claim 9 wherein the track is formed adjacent its end more remote from the base with a shallow zone to comprise a ride-by barrier for the movement of the lug and the cup.

13. A lipstick as claimed in claim 9 wherein the base is tapered toward the cup and is connected to the cam sleeve by being formed with a peripheral bead in the tapered area, and the sleeve is formed with an annular recess, the bead and recess being rotatably interengaged and the adjacent end of the cam sleeve engaging the taper to comprise a seal for the connection.

14. A lipstick as claimed in claim 9 wherein the container includes an inverted cup-shaped cap having a seal insert secured to the inside of the top wall of the cap, the upper end of the cam sleeve engages the insert to comprise a seal.

15. A lipstick as claimed in claim 14 wherein the insert includes a downward annular wall frictionally engaging the inside of the cam sleeve.

16. A pre-form for making a pomade-carrying assembly for a lipstick, comprising an elongate one-piece shape formed with a cup at its upper end and a base at its lower end and a plurality of telescopable sections intermediate the cup and base elements, contiguous surfaces of the telescopable sections being of similar non-circular cross-sectional configuration and progressively lesser dimension as one end of the shape is approached, the elements being held in a continuous line by integral frangible connectors extending respectively from a lower portion of the next-above section to an upper portion of the next-below section, the shape being collapsible upon the application of a force axial of the shape as the frangible connectors break and the telescopable elements slide into each other to produce a cup and a base connected for rotation together by a column of variable length.

17. A lipstick as claimed in claim 16 wherein part of the base and part of the cup also comprise telescopable sections.

18. A lipstick as claimed in claim 16 wherein longitudinally aligned adjacent surfaces of the pre-form are formed with a hook and a longitudinal groove respectively, the groove being sized to receive the hook after collapse of the shape.

19. A lipstick as claimed in claim 18 wherein the hook and groove are longitudinally aligned with a frangible connector.

20. A lipstick as claimed in claim 18 wherein the groove stops short of the end of the section closer to the hook.

21. A lipstick as claimed in claim 16 wherein at least one of the telescopable sections is formed with an outward flange.

22. A process for assembly of a lipstick comprising the steps of:

(1) providing a cam sleeve having a spiral track, (2) providing a pomade-carrying assembly pre-form defined by an elongate shape formed with a cup element at its upper end, the cup element having an outward lug, and a base element at its lower end and a plurality of telescopable elements intermediate the cup and base elements, the telescopable elements being of similar non-circular cross-sectional configuration and progressively lesser dimension as one end of the shape is approached, the elements being held in a continuous line by integral frangible connectors extending respectively from a lower portion of the next-above element to an upper portion of the next-below element, (3) applying an axial force to the pre-form to thereby collapse the shape as the frangible connectors break and the telescopable elements slide into each other to produce a pomade-carrying assembly comprising a cup and a base connected for rotation together by a column of variable length, and (4) inserting the pomade-carrying assembly into the cam sleeve with the lug in the track and connecting the base rotatably to the lower end of the cam sleeve.

23. A process as claimed in claim 22 including the additional step of confining the pre-form with lateral support during the collapse.

* * * * *